US008057196B2

(12) United States Patent
Wood

(10) Patent No.: US 8,057,196 B2
(45) Date of Patent: Nov. 15, 2011

(54) COMPRESSOR ASSEMBLY HAVING COUNTER ROTATING MOTOR AND COMPRESSOR SHAFTS

(75) Inventor: Mark W. Wood, Jackson, TN (US)

(73) Assignee: Black & Decker Inc., Newark, DE (US)

( * ) Notice: Subject to any disclaimer, the term of this patent is extended or adjusted under 35 U.S.C. 154(b) by 1491 days.

(21) Appl. No.: 10/443,324

(22) Filed: May 21, 2003

(65) Prior Publication Data

US 2006/0078438 A1 Apr. 13, 2006

Related U.S. Application Data

(60) Provisional application No. 60/382,123, filed on May 21, 2002.

(51) Int. Cl.
*F04B 17/00* (2006.01)

(52) U.S. Cl. ..... 417/362; 417/415

(58) Field of Classification Search ..... 417/362, 417/415; 92/140; 74/70, 101, 133, 134, 74/135, 117, 148

See application file for complete search history.

(56) References Cited

U.S. PATENT DOCUMENTS

| | | | | | |
|---|---|---|---|---|---|
| 1,694,218 | A * | 12/1928 | Hazard | 417/243 |
| 2,013,017 | A * | 9/1935 | Vogt | 417/250 |
| 3,852,963 | A * | 12/1974 | Hufstader | 60/717 |
| 4,919,598 | A * | 4/1990 | Wycliffe | 417/362 |
| 5,800,132 | A * | 9/1998 | Marietti | 417/238 |
| 5,836,280 | A * | 11/1998 | Miyazawa | 123/193.4 |
| 6,357,338 | B2 * | 3/2002 | Montgomery | 92/140 |

* cited by examiner

*Primary Examiner* — Ehud Gartenberg
*Assistant Examiner* — Vikansha Dwivedi
(74) *Attorney, Agent, or Firm* — Rhonda L. Barton; Michael P. Leary; Adan Ayala

(57) ABSTRACT

A compressor assembly includes a compressor coupled to a motor via a belt drive. The belt drive provides a speed reduction between the motor and compressor and causes the compressor shaft to rotate in the direction opposite that of the motor shaft. The relative values of the mass moments of inertia about the axes of rotation of the rotating motor and compressor shafts are engineered to be inversely proportional to the relative shaft speeds, allowing the mass moments of inertia to be balanced to at least substantially eliminate torsional vibration.

21 Claims, 7 Drawing Sheets

COMPRESSOR ASSEMBLY HAVING COUNTER ROTATING MOTOR AND COMPRESSOR SHAFTS

CROSS-REFERENCE TO RELATED APPLICATIONS

The present application claims the benefit under 35 U.S.C. §119(e) of U.S. Provisional Patent Application Ser. No. 60/382,123 filed May 21, 2002. Said U.S. Provisional Patent Application Ser. No. 60/382,123 is herein incorporated by reference in its entirety.

FIELD OF THE INVENTION

The present invention generally relates to compressor assemblies, and, more particularly, to a compressor assembly having counter rotating motor and compressor shafts.

BACKGROUND OF THE INVENTION

Traditional positive displacement (reciprocating piston) compressor assemblies include a compressor coupled to a motor using belt drive or direct drive mechanisms which transfer power from the motor to the compressor for reciprocating the piston (or pistons) of the compressor. Conventionally, in such belt drive and direct drive configurations, the drive shaft of the motor (herein after referred to as the motor shaft) and the crank shaft of the compressor (hereinafter referred to as the compressor shaft) turn in the same direction to simplify the drive train of the compressor assembly.

A significant problem with reciprocating piston compressors is that the torque of the compressor shaft varies significantly during rotation of the shaft (i.e., reciprocation of the piston) causing excessive torsional vibration of the compressor assembly. In the past, three common methods have been used for reducing such torsional vibration. The first of these methods was to divide the compressor displacement into several smaller piston/cylinder assemblies. The second method was to increase the size and moment of inertia of the compressor flywheel. These solutions add cost and size to the compressor and have practical upper limits. The third method involved increasing compressor speed. However, this solution also generates excessive noise and increases reciprocating imbalance. Moreover, the effectiveness of all three solutions is limited to reduction rather than elimination of torsional vibration and requires compromise between the types of imbalance and noise reduction.

Consequently, it is desirable to provide a compressor assembly having a reciprocating piston compressor driven by a motor, wherein torsional vibration in the compressor assembly is greatly reduced or eliminated.

SUMMARY OF THE INVENTION

Accordingly, the present invention is directed to a compressor assembly suitable for use in a compressor such as an air compressor, or the like, having counter rotating motor and compressor shafts with mass moments of inertia balanced to substantially eliminate torsional vibration.

In exemplary embodiments, the compressor assembly includes a compressor coupled to a motor (e.g., an electric motor, an engine, or the like) via a belt drive. The belt drive provides a speed reduction between the motor and compressor and causes the compressor shaft to rotate in the direction opposite that of the motor shaft. The relative values of the mass moments of inertia about the axes of rotation of the rotating motor and compressor shafts are engineered to be generally inversely proportional to the relative shaft speeds. In this manner, the mass moments of inertia may be balanced to substantially eliminate torsional vibration.

It is to be understood that both the forgoing general description and the following detailed description are exemplary and explanatory only and are not necessarily restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which:

FIGS. 7 and 8 are isometric views illustrating exemplary compressors, in particular, air compressors, employing the compressor assembly of the present invention, wherein FIG. 7 illustrates an air compressor having a horizontally oriented tank and FIG. 8 illustrates an air compressor having a vertically oriented tank.

DETAILED DESCRIPTION OF THE INVENTION

Figure 1:
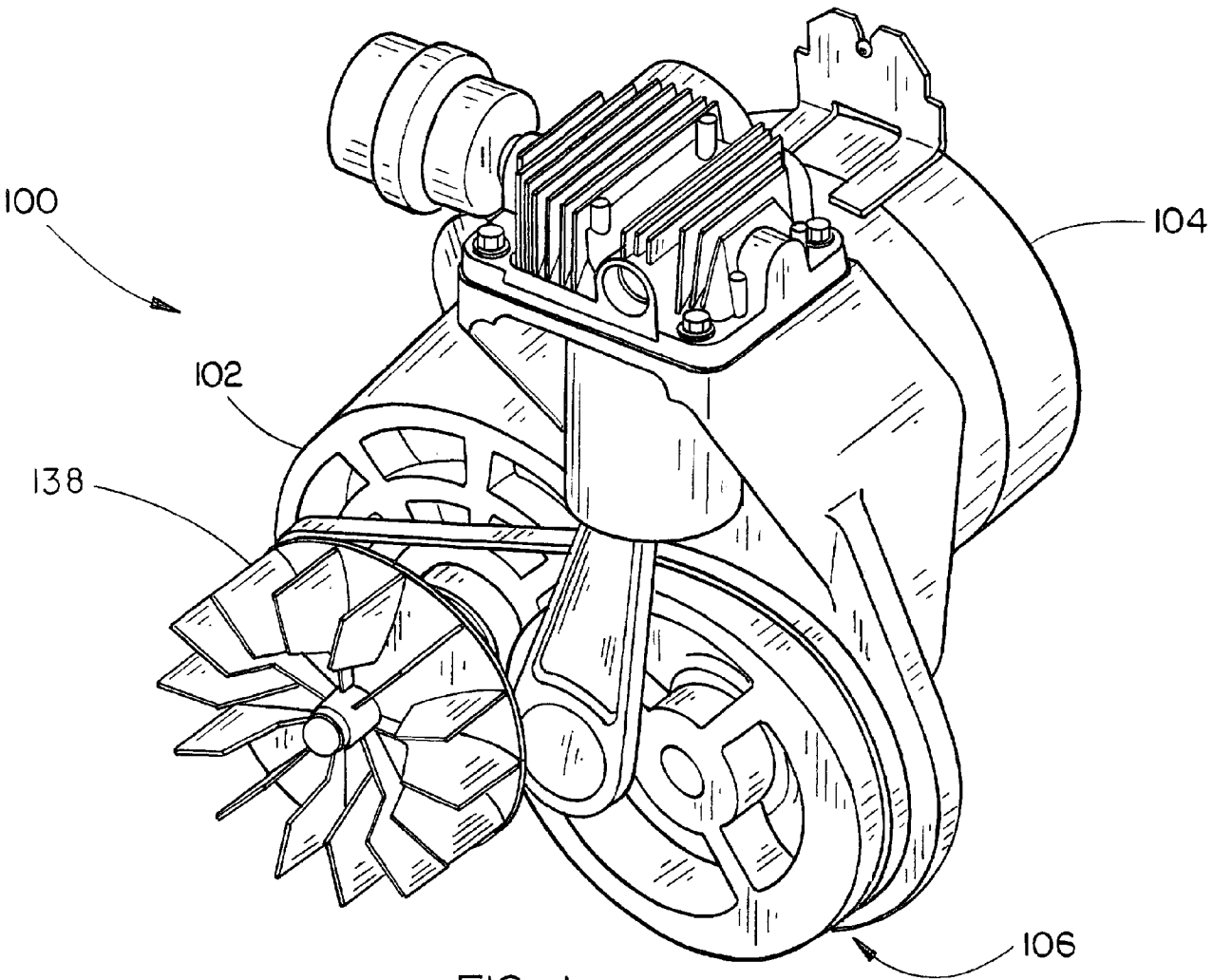
FIG. 1 is an isometric view illustrating a compressor assembly in accordance with an exemplary embodiment of the invention.
Figure 2:
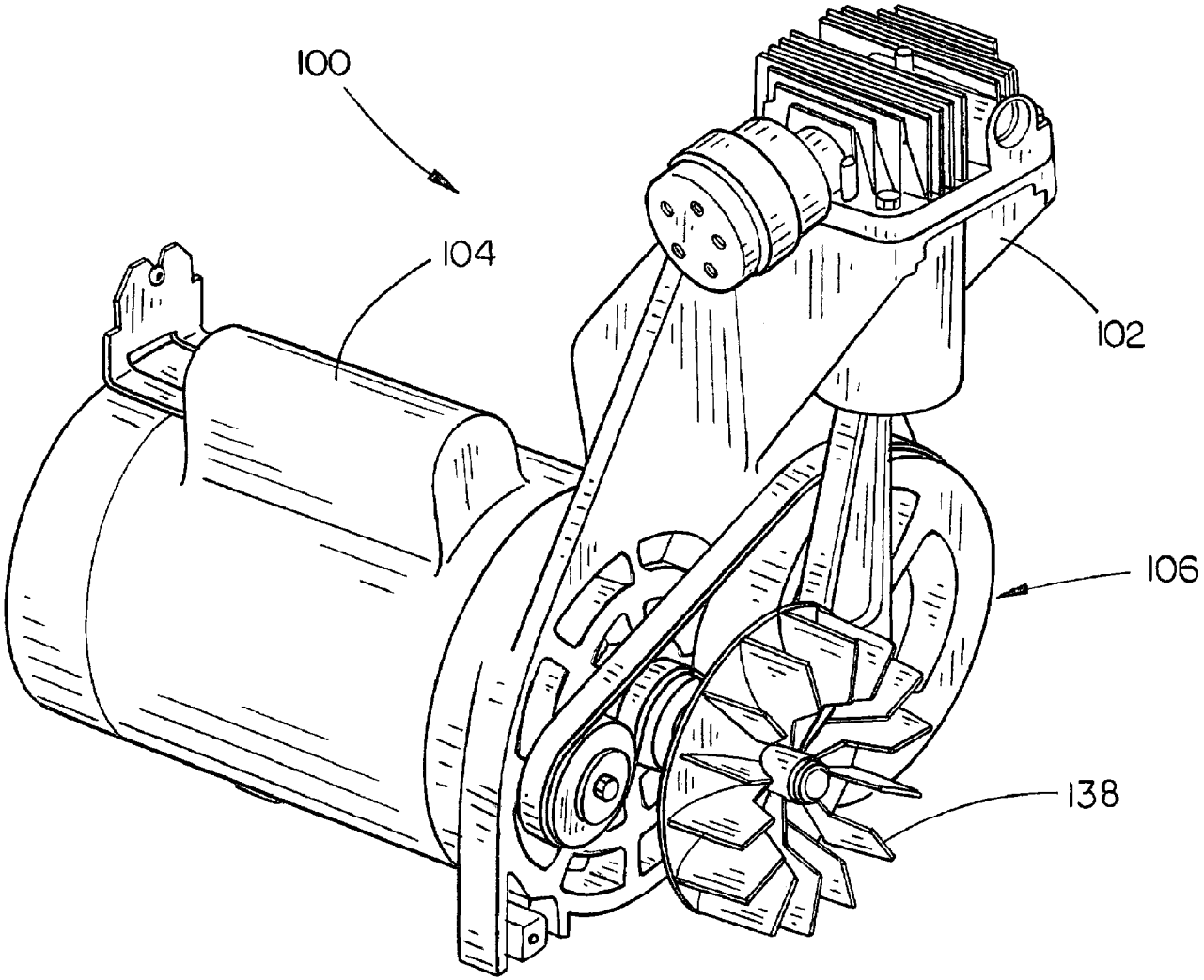
FIG. 2 is an isometric view of the compressor assembly shown in FIG. 1, further illustrating the drive train of the compressor assembly.
Figure 3:
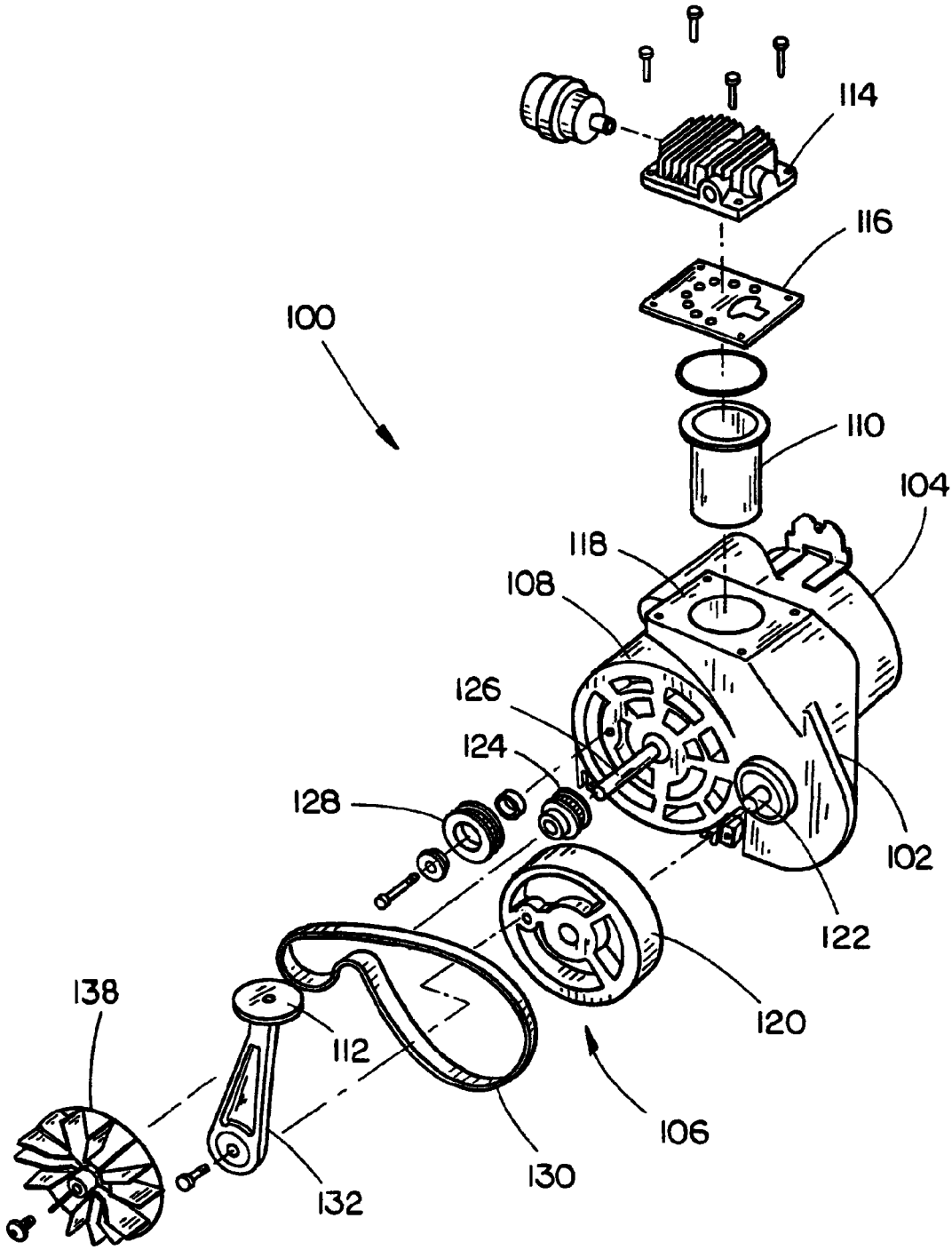
FIG. 3 is an exploded isometric view of the compressor assembly shown in FIG. 1.
Figure 4:
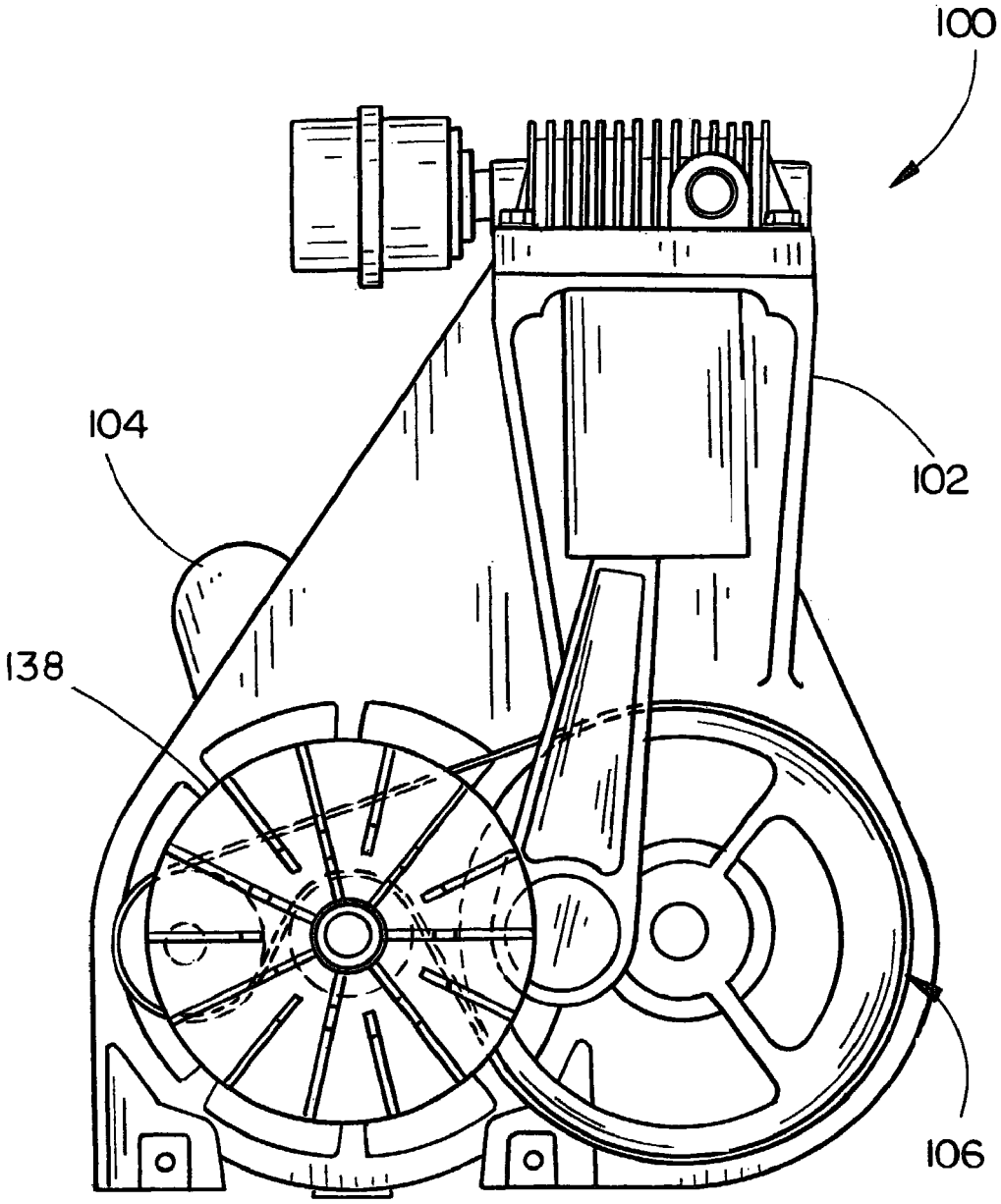
FIG. 4 is a front elevation view of the compressor assembly shown in FIG. 1.
Figure 5:
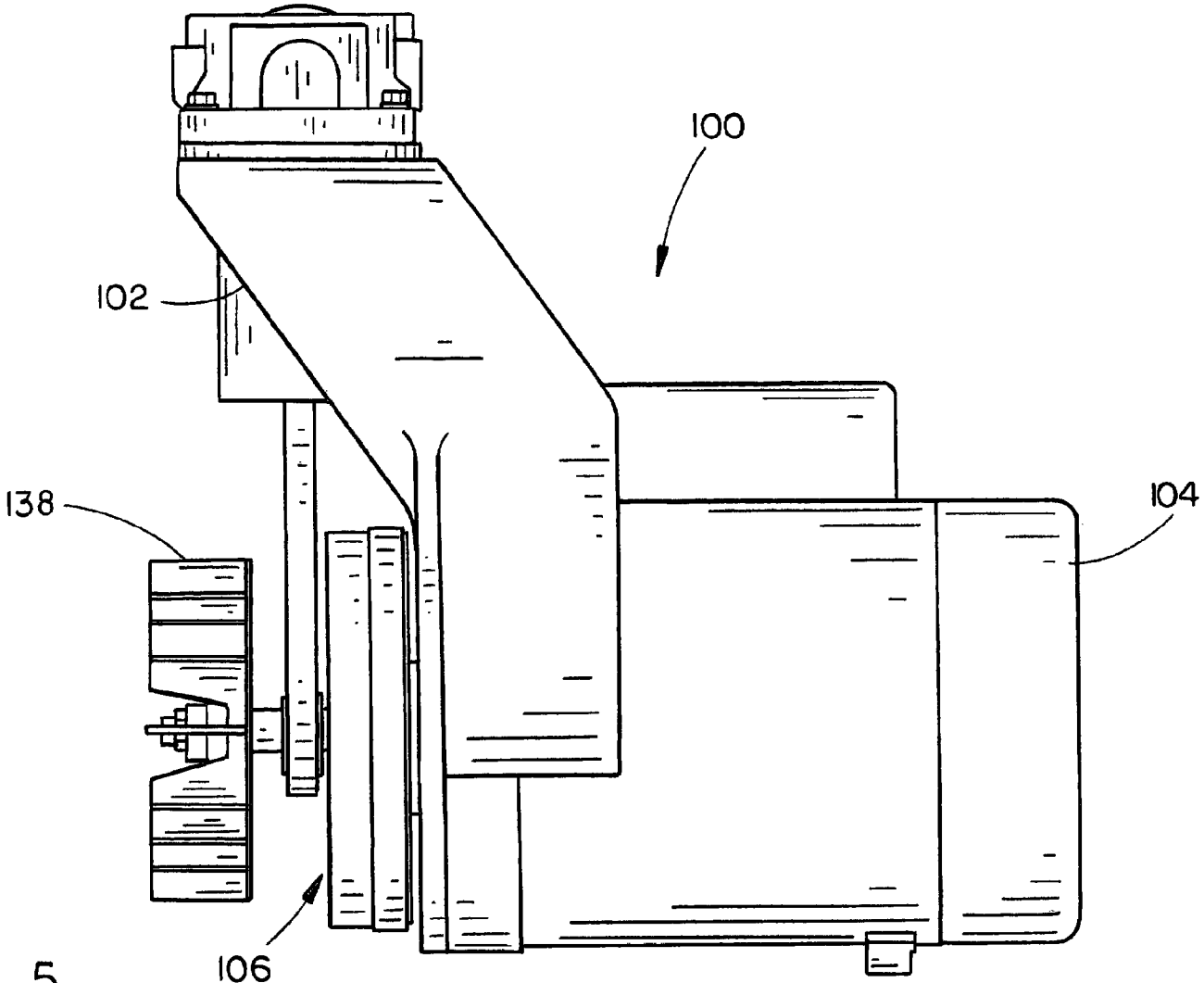
FIGS. 5 and 6 are left and right side elevation views of the compressor assembly shown in FIG. 1.
Figure 6:
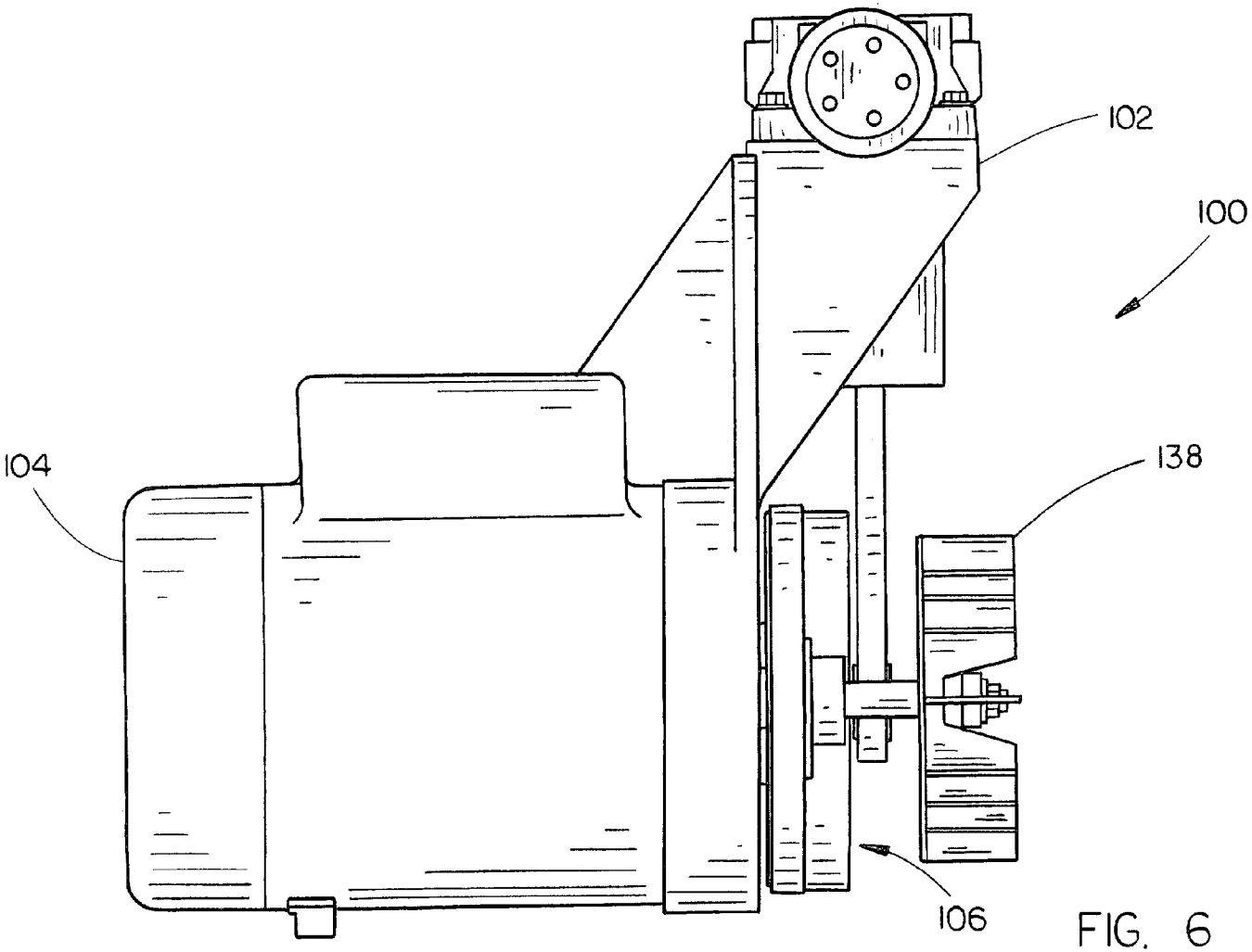

Reference will now be made in detail to the presently preferred embodiments of the invention, examples of which are illustrated in the accompanying drawings.

Referring generally FIGS. 1 through 6, a compressor assembly 100 in accordance with an exemplary embodiment of the present invention is described. The compressor assembly 100 includes a reciprocating piston compressor 102 coupled to a motor assembly (e.g., an electric motor, engine, or the like) 104 via a belt drive 106. In the embodiment illustrated, the compressor 102 includes a compressor housing 108 having a cylinder assembly 110 in which a piston 112 is reciprocated for compressing a gas such as air, or the like. The compressor 102 further includes a head assembly 114 having a valve plate 116 mounted to a boss 118 formed in the compressor housing 108 enclosing the cylinder assembly 110. The head assembly 114 supplies atmospheric air (air at atmospheric pressure) to the cylinder assembly 110 and delivers pressurized air, compressed by the piston 112, from the cylinder assembly 110 for charging a compressed air storage tank (see FIG. 7), powering air powered tools, or the like.

The belt drive 106 includes a flywheel 120 mounted to the compressor shaft 122, a motor sprocket 124 mounted to the motor shaft 126, and a belt idler or idler bearing 128 mounted to the compressor housing 108. The flywheel 120 and belt idler 128 receive the belt 130, which passes over the motor sprocket 124. In the exemplary embodiment illustrated, the belt 130 comprises a flat belt formed of a material such as rubber, or the like, which may have a central cord of a material such as nylon for added strength. However, it will be appreciated by those of ordinary skill in the art, that the belt 130 may alternatively comprise other types of belts (e.g., a poly V belt, a timing belt, etc.), chains (e.g., a bicycle chain), or the like, without departing from the scope and intent of the present invention.

As shown in FIGS. 1 through 6, the piston 112 includes a connecting rod 132 journaled to the flywheel 120 eccentrically, at or near the periphery of the flywheel 120 (e.g., via a fastener such as a bolt received in a hole formed in the flywheel 120 at or near the periphery of the flywheel), so that the flywheel 120 acts as an eccentric for reciprocating the piston 112. The belt 130 passes over and is driven by the motor sprocket 124, which is coupled to the spinning motor shaft 126. The belt 130 rotates the flywheel 120 turning the compressor shaft 122 and reciprocating the piston 112. The belt idler 128 is used for tensioning the belt 130 and for routing the belt 130 over the motor sprocket 124 to provide counter or reverse rotation between the flywheel 120 and compressor shaft 122 and the motor sprocket 126 and motor shaft 126. The belt idler 128 rotates or turns in the same direction as the compressor shaft 122 and flywheel 120 (e.g., counterclockwise), and in a direction opposite the direction that the motor shaft 126 and motor sprocket 124 rotate or turn (e.g., clockwise).

In accordance with the present invention, the belt drive 106 provides a speed reduction between the motor 104 and the compressor 102 (i.e., provides a reduction in rotational speed between the motor shaft 126 and the compressor shaft 122) and causes the compressor shaft 122 to rotate in a direction opposite the direction of rotation of the motor shaft 126. Preferably, the relative values of the mass moments of inertia about the axes of rotation of the rotating motor and compressor shafts 122 & 126 are calculated to be at least approximately inversely proportional to the relative shaft speeds of the shafts. Since the belt idler 128 rotates in the same direction as the compressor shaft 122 and flywheel 120, the belt idler inertia product is added to the inertia product of the compressor rotating components. The mass moment of inertias and shaft rotational speeds (RPM) of the motor shaft 126 and the compressor shaft 122 are thus related by the expression:

$$Ic+Ii\cdot Ni/Nc=Im\cdot Nm/Nc$$

where Ic is the mass moment of inertia of the compressor shaft 122 including the mass moment of inertias for all rotating compressor shaft components (e.g., compressor shaft 122, flywheel 120, and the like), Nc is the shaft rotational speed of the compressor shaft 122, Ii is the mass moment of inertia of the belt idler 128 including the mass moment of inertias for all rotating belt idler components (e.g., shaft 134, idler sprocket 136, and the like), Ni is the shaft rotational speed of the belt idler 128, Im is the mass moment of inertia of the motor shaft 126 including the mass moment of inertias for all rotating motor shaft components (e.g., motor shaft 126, motor sprocket 124, fan 138, and the like), and Nm is the shaft rotational speed of the motor shaft 126. For example, in one specific embodiment, if the speed of compressor shaft 122 is one half of the speed of the motor shaft 126, the mass moment of inertia of the rotating compressor shaft 122 (including the mass moment of inertia of the belt idler 128) is calculated to be at least approximately twice that of the rotating motor shaft 126. In this manner, the mass moments of inertia may be balanced to eliminate or at least substantially eliminate torsional vibration in compressor assembly 100.

Figure 8:
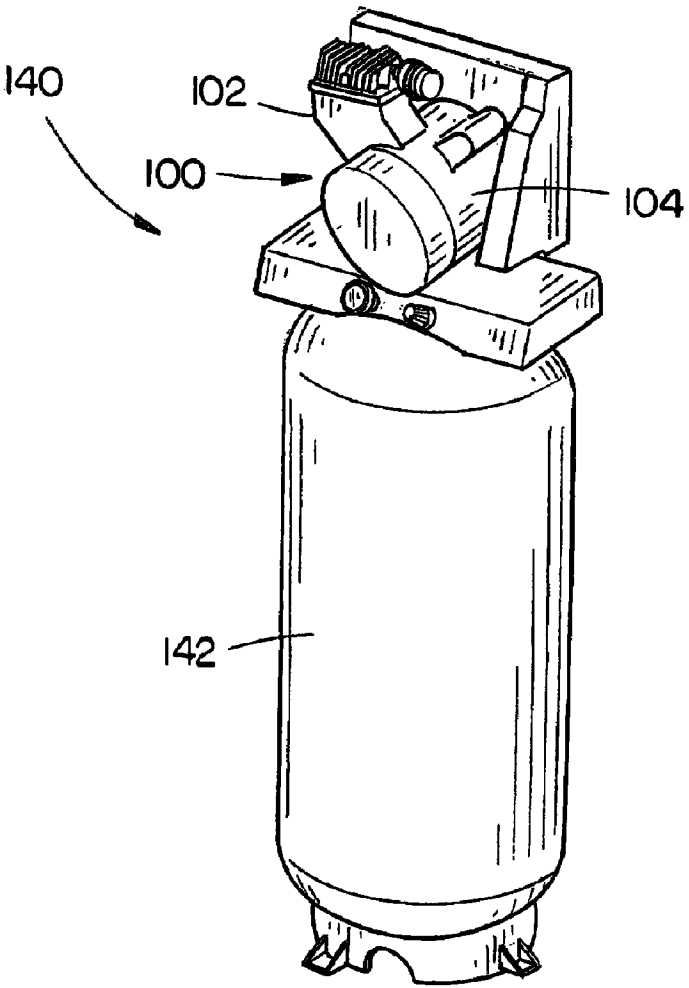
Figure 7:
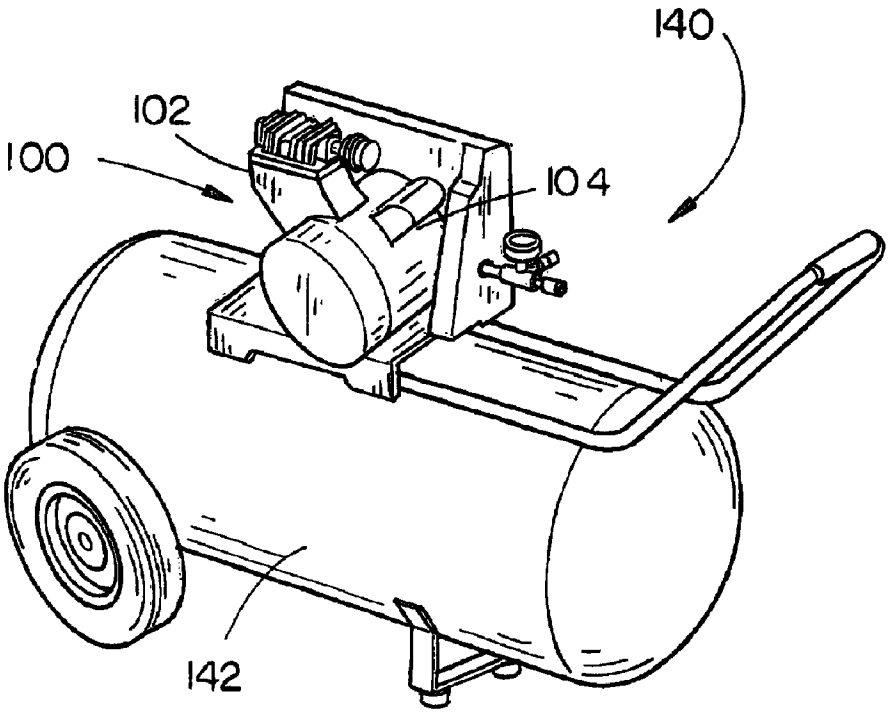

FIGS. 7 and 8 illustrate exemplary air compressors 140 employing the compressor assembly 100 in accordance with the present invention. In air compressors 140, the compressor assembly 100 is mounted to a compressed air storage tank 142. The compressor assembly 102 provides compressed air to the compressed air storage tank 142 for charging the tank. The compressed air storage tank 142 provides a reservoir or receiver for storing air under pressure. A port (often referred to as a "spud") is provided in the compressed air storage tank 142 to which a pressure manifold or pipe is fitted allowing compressed air to be drawn from the tank for powering air powered tools such as nailing tools, socket driving tools, material shaping tools, sanding tools, spray painting tools, tire inflation chucks, and the like. A pressure switch assembly is mounted to the pressure manifold for regulating pressure within the compressed air storage tank 142 by alternately starting and stopping the compressor assembly 100 to periodically replenish the supply of air in the tank. When pressure within the compressed air storage tank 142 reaches a preset low pressure point, or "kick-in pressure", the pressure switch assembly starts the motor 104 of the compressor assembly 100 to power the compressor 102 of the assembly to repressurize the tank. As the pressure within the compressed air storage tank 142 reaches a preset high pressure point, or "kick-out pressure," the pressure switch assembly stops the motor 104 to prevent over-pressurization of the tank. In this manner, the pressure of the compressed air within the compressed air storage tank 142 is maintained within a desired range.

It is believed that the present invention and many of its attendant advantages will be understood by the forgoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof. It is the intention of the following claims to encompass and include such changes.

What is claimed is:

1. A compressor assembly, comprising:

a compressor for compressing a gas, the compressor including a piston reciprocated in a cylinder and a compressor shaft;

a motor assembly for providing motive force to the compressor, the motor assembly including a motor shaft; and a belt drive for coupling the motor shaft to the compressor shaft for reciprocating the piston within the cylinder, the belt drive including:

a belt;

a flywheel mounted to the compressor shaft and coupled to the piston:

a motor sprocket mounted to the motor shaft; and a belt idler, the flywheel and belt idler receiving the belt so that the belt passes over the motor sprocket and is driven by the motor sprocket, wherein the belt drive provides a reduction in the speed of rotation between the motor shaft and the compressor shaft and causes the compressor shaft to rotate in a direction opposite the motor shaft.

2. The compressor assembly as claimed in claim 1, wherein relative values of mass moments of inertia about axes of rotation of the motor shaft and the compressor shaft are generally inversely proportional to the relative shaft rotational speeds of the motor shaft and the compressor shaft.

3. The compressor assembly as claimed in claim 2, wherein the mass moments of inertia of the motor shaft and the compressor shaft are balanced for substantially eliminating torsional vibration of the compressor assembly.

4. The compressor assembly as claimed in claim 1, wherein the motor shaft rotates in a direction opposite the belt idler.

5. The compressor assembly as claimed in claim 4, wherein the mass moment of inertia and the shaft rotational speeds of the motor shaft and the compressor shaft are related by the expression:

$$Ie+Ii\cdot Ni/Nc=Im\cdot Nm/Nc$$

where Ie is the mass moment of inertia of the compressor shaft, Nc is the shaft rotational speed of the compressor shaft, Ii is the mass moment of inertia of the belt idler, Ni is the shaft rotational speed of the belt idler, Im is the mass moment of inertia of the motor shaft, and Nm is the shaft rotational speed of the motor shaft.

6. The compressor assembly as claimed in claim 1, wherein the piston comprises a piston rod journaled to the flywheel eccentrically so that the flywheel functions as an eccentric for reciprocating the piston.

7. A compressor, comprising:

a storage tank, for storing a gas under pressure;

a compressor assembly for compressing the gas and charging the storage tank, the compressor assembly including:

a compressor including a piston reciprocated in a cylinder and a compressor shaft;

a motor assembly for providing motive force to the compressor, the motor assembly including a motor shaft; and a belt drive for coupling the motor shaft to the compressor shaft for reciprocating the piston within the cylinder, and the belt drive provides a reduction in the speed of rotation between the motor shaft and the compressor shaft and causes the compressor shaft to rotate in a direction opposite the motor shaft, wherein the mass moments of inertia about axes of rotation of the motor shaft and the compressor shaft are balanced for substantially eliminating torsional vibration of the compressor assembly.

8. The compressor as claimed in claim 7, wherein relative values of mass moments of inertia about axes of rotation of the motor shaft and the compressor shaft are generally inversely proportional to the relative shaft rotational speeds of the motor shaft and the compressor shaft.

9. The compressor as claimed in claim 7, wherein the belt drive comprises:

a belt;

a flywheel mounted to the compressor shaft and coupled to the piston;

a motor sprocket mounted to motor shaft; and a belt idler;

wherein the flywheel and belt idler receive the belt and the belt passes over the motor sprocket and is driven by the motor sprocket.

10. The compressor as claimed in claim 9, wherein the motor shaft rotates in a direction opposite the belt idler.

11. The compressor as claimed in claim 10, wherein the mass moment of inertias and shaft rotational speeds of the motor shaft and the compressor shaft are related by the expression:

$$Ie+Ii\cdot Ni/Nc=Im\cdot Nm/Nc$$

where Ie is the mass moment of inertia of the compressor shaft, Ne is the shaft rotational speed of the compressor shaft, Ii is the mass moment of inertia of the belt idler, Ni is the shaft rotational speed of the belt idler, Im is the mass moment of inertia of the motor shaft, and Nm is the shaft rotational speed of the motor shaft.

12. The compressor as claimed in claim 9, wherein the piston comprises a piston rod journaled to the flywheel eccentrically so that the flywheel functions as an eccentric for reciprocating the piston.

13. The compressor as claimed in claim 9, wherein the relative values of mass moments of inertia about axes of rotation of the motor shaft and the compressor shaft are generally inversely proportional to the relative shaft rotational speeds of the motor shaft and the compressor shaft.

14. An air compressor, comprising:

a compressed air storage tank for storing air under pressure;

a compressor assembly for charging the compressed air storage tank, the compressor assembly including:

a compressor for compressing a gas, the compressor including a piston reciprocated in a cylinder and a compressor shaft;

a motor assembly for providing motive force to the compressor, the motor assembly including a motor shaft; and a belt drive for coupling the motor shaft to the compressor shaft for reciprocating the piston within the cylinder, the belt drive including:

a belt;

a flywheel mounted to the compressor shaft and coupled to the piston;

a motor sprocket mounted to the motor shaft; and a belt idler, the flywheel and belt idler receiving the belt so that the belt passes over the motor sprocket and is driven by the motor sprocket;

wherein the belt drive provides a reduction in the speed of rotation between the motor shaft and the compressor shaft and causes the compressor shaft to rotate in a direction opposite the motor.

15. The air compressor as claimed in claim 14, wherein relative values of mass moments of inertia about axes of rotation of the motor shaft and the compressor shaft are generally inversely proportional to the relative shaft rotational speeds of the motor shaft and the compressor shaft.

16. The air compressor as claimed in claim 15, wherein the mass moments of inertia of the motor shaft and the compressor shaft are balanced for substantially eliminating torsional vibration of the compressor assembly.

17. The air compressor as claimed in claim 15, wherein the motor shaft rotates in a direction opposite the belt idler.

18. The air compressor as claimed in claim 17, wherein the mass moment of inertias and the shaft rotational speeds of the motor shaft and the compressor shaft are related by the expression:

$$Ie+Ii\cdot Ni/Nc=Im\cdot Nm/Nc$$

where Ie is the mass moment of inertia of the compressor shaft, Nc is the shaft rotational speed of the compressor shaft, Ii is the mass moment of inertia of the belt idler, Ni is the shaft rotational speed of the belt idler, Im is the mass moment of inertia of the motor shaft, and Nm is the shaft rotational speed of the motor shaft.

19. The air compressor as claimed in claim 14, wherein the piston comprises a piston rod journaled to the flywheel eccentrically so that the flywheel functions as an eccentric for reciprocating the piston.

20. A compressor assembly, comprising:

a compressor for compressing a gas, the compressor including a piston reciprocated in a cylinder and a compressor shaft;

a motor assembly for providing motive force to the compressor, the motor assembly including a motor shaft; and means for coupling the motor shaft to the compressor shaft for reciprocating the piston within the cylinder, the coupling means providing a reduction in the speed of rotation between the motor shaft and the compressor shaft and causing the compressor shaft to rotate in a direction opposite the motor shaft;

wherein the mass moments of inertia about axes of rotation of the motor shaft and the compressor shaft are balanced for substantially eliminating torsional vibration of the compressor assembly.

21. A compressor assembly, comprising:

a motor assembly, the motor assembly including a motor shaft and a motor sprocket mounted to the motor shaft;

a cylinder;

a piston mounted in the cylinder for reciprocation;

a flywheel mounted on a compressor shaft for rotation therewith;

a connecting rod journaled eccentrically to the flywheel and connected to the piston so that rotation of the flywheel drives the piston in reciprocation;

a drive belt; and a belt idler, the flywheel and belt idler receiving the drive belt so that the drive belt passes over the motor sprocket and is driven by the motor sprocket, wherein the flywheel rotates at a lower speed than the motor shaft and the flywheel rotates in a direction opposite to the motor shaft.

* * * * *